United States Patent [19]

Wilson

[11] Patent Number: 4,973,011

[45] Date of Patent: Nov. 27, 1990

[54] DEVICE FOR UNWINDING COILED MATERIAL FROM CARTON

[76] Inventor: Laurence A. Wilson, R.D. #1 Box 55, Uniondale, Pa. 18470

[21] Appl. No.: 477,031

[22] Filed: Feb. 8, 1990

[51] Int. Cl.[5] ..... B65H 49/28

[52] U.S. Cl. ..... 242/129.000

[58] Field of Search ..... 242/129, 128, 105, 129.5, 242/134, 137, 139, 141, 146

[56] References Cited

U.S. PATENT DOCUMENTS

| | | | |
|---|---|---|---|
| 2,985,404 | 5/1961 | Tashiro | 242/129 |
| 3,041,006 | 6/1962 | Eckert | 242/128 |
| 3,118,634 | 1/1964 | Shumake | 242/129 |
| 3,218,002 | 11/1965 | Derrickson | 242/128 |
| 3,593,943 | 7/1971 | Collmann | 242/129 |
| 3,974,980 | 8/1976 | Marcell | 242/128 |
| 4,471,921 | 9/1984 | Corbin | 242/129 |
| 4,667,897 | 5/1987 | Burrow et al. | 242/129 |
| 4,826,100 | 5/1989 | Belliveau | 242/129 |

*Primary Examiner*—Stanley N. Gilreath

[57] ABSTRACT

An improved device which allows a carton of coiled wire, packaged in a way to allow the coil to be unwound from its center through a circular knockout in the carton, to rotate as the wire is being pulled out of the center knockout. As the wire is pulled it makes contact with a flared center column. The action of the wire against the center column and the pull of the wire on the coil causes the device and the carton of wire to rotate. This rotating action prevents twists and kinks in the wire and allows it to unwind easily. The device can be operated sitting on a surface, hanging from a support or held in the operators hand. The device has no parts that adjust or need to be removed in order to mount a carton of coiled wire and there is no need for the wire to be fed through a guide. The wire can be pulled at angles from near horizontal to approximately 45 degrees up off horizontal and in any direction.

11 Claims, 2 Drawing Sheets

DEVICE FOR UNWINDING COILED MATERIAL FROM CARTON

BACKGROUND OF THE INVENTION

1. Field of the Invention

The invention is an improved device for the unwinding of electrical wire, communication cable, or other coiled material from the cardboard carton in which it is typically packaged in a free flowing way without removing the main coil of material from the carton and without creating twists of kinks in the material.

2. Description of Prior Art

Similar devices can be described in two categories: devices that are suspended from a structure above the device, and devices that sit on a base requiring a somewhat level and smooth surface. There appears to be no prior art designed to operate in both a suspended position and a sitting position. A third position for operation of an unwinding device that has not been addressed by prior art is for the operator of the device to hold it in his/her hand during operation.

The use of removable or adjustable parts in prior art is a disadvantage because they can become lost and require more set up time. Guides through which the material must be threaded also require more set up time and tend to create friction especially with some of the larger and stiffer wires, or softer plastic tubing.

Tashiro, U.S. Pat. No. 2,985,404 (1961) describes a device that operates only sitting on a base and has no provision for moving it from one location to another. It also has removable parts.

Eckert, U.S. Pat. No 3,041,006 (1962) describes a device that also only operates sitting on a base and has both removable parts and a guide through which the wire must be fed. The center column in this device does not rotate which causes friction as the wire moves around it. The wire guide is also the carrying handle but cannot function as both simultaneously. The wire guide also is designed for small diameter round wire. If the carton of wire is very heavy the handle would not be very comfortable to use.

Shumake, U.S. Pat. No. 3,118,634 (1964) describes a device that also only operates sitting on a base, is designed primarly for small diameter round wire and uses two guides through which the wire has to be fed. It also has clamps to hold the carton in place which require all the cartons used to be of similar size.

Collmann, U.S. Pat. No. 3,593,943 (1971) describes a device that also only operates sitting on a base and has parts that need to be removed and then replaced to mount the carbon of wire. The handle for carrying the device is threaded into the center column of the device and will tend to loosen when being carried.

Marcell, U.S. Pat. No. 3,974,980 (1976) describes a device that operates in a suspended position only and has parts that require unfastening and refastening and adjusting. It also has a wire guide through which the wire is fed. It does not have a means to carry it from one location to another in operational mode.

3. Objects and Advantages

It should be noted that even though the present invention can be used to unwind a variety of materials, it is primarily intended for use with wire. Therefore it will be described as used in connection with wire coils but should be understood that the term "wire" is intended to designate any material that might be used with the device.

It is the object of this invention to improve on prior devices and provide:

(a) A device that can be operated either suspended or resting on a base. Sometimes, especially in remoldeling work, there is no place from which to hang a device. On the other hand in a muddy unfinished cellar or crawlspace there is often on place to set a device down, thus the need for a device that can operate in either position.

(b) A device that can be operated while held in the operator's hand by the handle allowing the operator to move from one point to another reeling out the coiled wire. This has a great advantage when working in situations where pulling or dragging the uncoiled wire across rough, abrasive, muddy or uneven surfaces might cause damage to the wire.

(c) A device that has no parts that need to be removed, unfastened, or adjusted to mount or unmount coiled wire in its carton or to operate the device, thus reducing loose or lost parts and reducing the time required to change cartons.

(d) A device that does not require the wire to be threaded through a guide allowing for a wider range of materials to be used and also making changing cartons easier and faster.

The device (1) has no parts that need to be removed or adusted to mount a carton of wire or to operate; (2) dispenses wire without the need of a wire guide through which the wire must be threaded: (3) can be operated siting on a surface, suspended, or held in the operators hand; and (4) has a comfortable handle to use in transporting the wire from one location to another. Field testing revealed no need for a braking mechanism to prevent overspinning. The hand-held method allows the operator to walk along as the coil turns, reeling out the wire as is necessary when placing it in a ditch, for example, without having to drag the wire along the ditch or along the ground causing possible damage to the wire or its protective cover.

SUMMARY OF THE INVENTION

The improved device that allows the unwinding of coiled wire from the cardboard carton in which it is packaged is characterized by the fact that it can be operated in any of three positions: (1) sitting on the floor or other surface, (2) held in the hand to reel out wire as the operator walks along, or (3) hangng from a floor joist or other overhead support. It also has no parts that need to be removed or adjusted in order to mount the carton or operate the device. Finally it does not require the wire to be fed through a guide thereby reducing friction, minimizing set-up time and allowing the wire to be pulled in any direction from the device.

The improved device is also characterized by the shape of the center column and by the retractable handle and bearing. The flared shape of the center column keeps the wire from climbing over the top of the column as it is pulled. The bearing on the handle allows the device to turn when it is suspended or while it is being held. The fact that the handle retracts out of the way into the center column allows the top of the column to be used as the template for the holes in the carton and makes the unit more compact and damage resistant when not in use.

Other objects, features, and characteristics of this invention, as well as the functions of other elements of the device, methods of operation, and the combination of parts and the economies of manufacture, will become apparent as the reader considers the following descriptions, accompanying drawings and claims.

REFERENCE NUMERALS IN DRAWINGS

Figure 1:
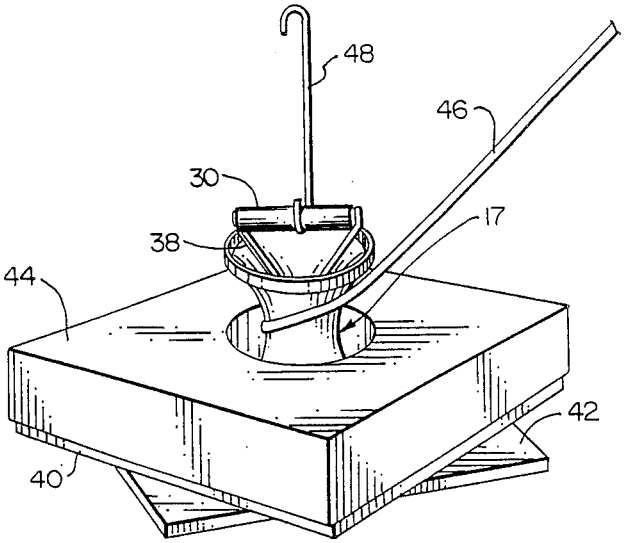
FIG. 1: Perspective view of device showing carton of coiled wire mounted and ready for unwinding.

10 circular base
12 circular carton support
14 upper portion of center column
16 lower portion of center column
17 center column
18 bolt
20 turntable bearing
22 shoulder of base (10)
24 locknut
24*a* locknut
26 collar
28 bearing
30 handle grip
32 groove in handle grip
38 handle strap
40 flat and square carton support
42 flat and square base
44 carton of wire
46 wire
48 suspension hook

DESCRIPTION OF FIGURES 1 TO 8

Figure 2:
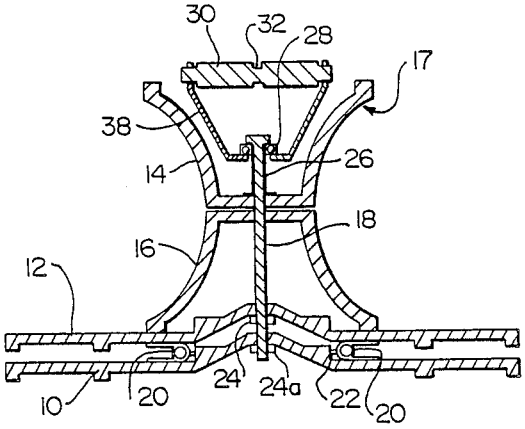
FIG. 2: Vertical section of device (through center of device) according to a first embodiment of the present device.

Referring now to FIG. 2 specifically, where all major parts of the device can be viewed in the cross section, the device sits on a circular base(10). A circular carton support (12) with a center column (17), comprised of an upper portion (14) and a lower portion (16), fastened to the carton support (12) by a bolt (18) and a locknut(24), sits on a turntable bearing(20) which sits on circular base(10). Turntable bearing(20) is held in position by a shoulder(22) of base(10). Base(10) is held in position on bolt(18) by a locknut(24*a*). Locknut (24*a*) holds base(10) in position but is not tight against it to allow rotation of the device on turntable bearing(20). A handle grip(30) and a handle strap(38) are mounted on bolt(18) with a bearing(28) allowing rotation of the device when handle grip(30) is held in fixed position. A groove(32) in handle grip(30) provides a center of gravity positioning of a suspension hook(48), illustrated in FIG. 1, from which the entire device can be hung. A collar(26) holds bearing(28) up under the head of bolt(18) up under the head of bolt(18). A hold in handle strap(38) which is just larger than the outside diameter of collar (26) allows handle strap(38) to move up and down along collar(26).

Figure 3:
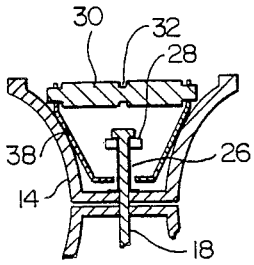
FIG. 3: Vertical section of retractable handle in retracted position.
Figure 4:
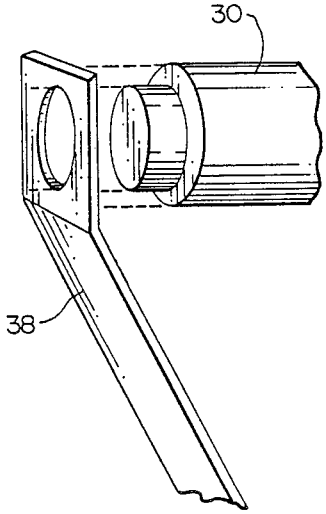
FIG. 4: Enlarged exploded perspective view of portion of handle grip and portion of handle strap.
Figure 5:
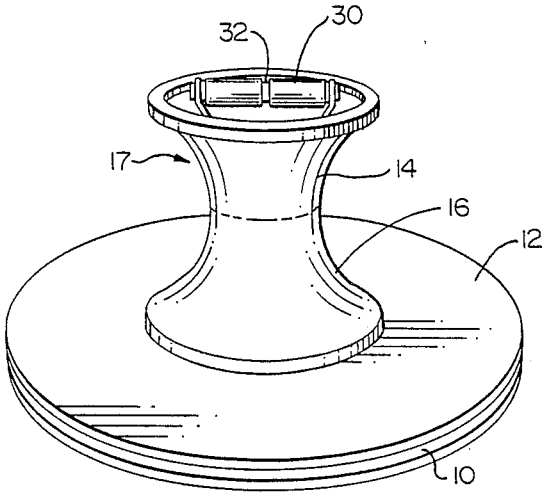
FIG. 5: Perspective view of the first embodiment.
Figure 6:
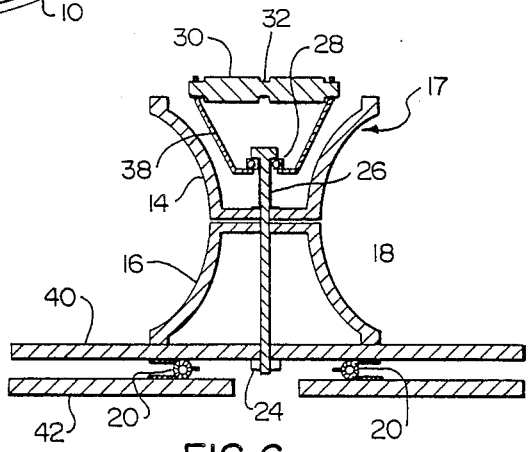
FIG. 6: Vertical section view of a second embodiment.
Figure 7:
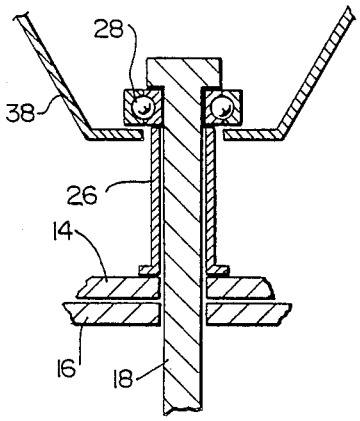
FIG. 7: Enlarged portion of vertical section of retractable handle.
Figure 8:
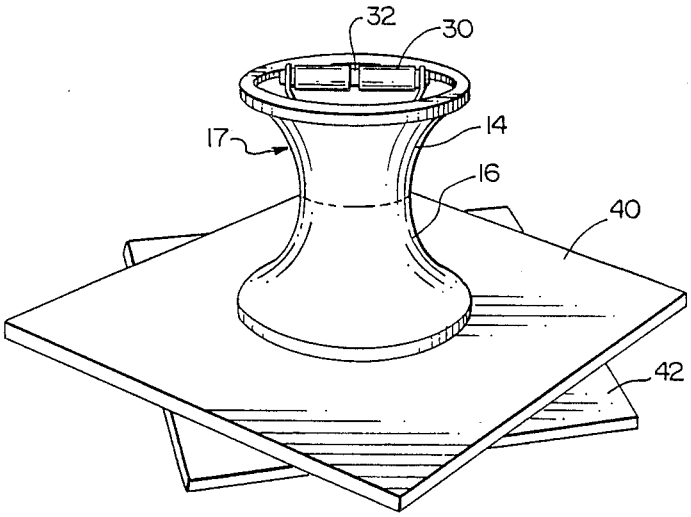
FIG. 8: Perspective view of the second embodiment.

FIG. 3 shows handle grip(30) and handle strap(38) in retracted position. FIG. 4, shows an enlarged, exploded perspective view of portion of handle grip(30) and portion of handle strap(38). FIG. 5, a perspective view of the first embodiment, shows the circular shape of base(10) and carton support(12). FIG. 6, is a vertical section of a second embodiment of the device, and FIGS. 1 and 8, perspective views of the second embodiment, show a flat and square carton support(40) fastened to turnable bearing(20) which is fastened to a flat and square base(42) with small screws. FIG. 7, is an enlarged portion of FIG. 2 or 5 showing vertical section of bolt (18), collar(26), bearing(28), and part of handle strap (38), upper column portion (14) and lower column portion (16).

The base (10), the coil and carton suppport (12) and the center column (17) may be formed of molded material with the coil and carton support (12) and the center column (17) being molded as a single unit.

OPERATIONAL DESCRIPTION OF FIGURES

A carton of wire(44), shown in FIG. 1, is prepared for mounting on the device by cutting a hole in the top and bottom center of carton(44). The size of the hole should be the same as outside diameter of the top of center column(17). The top of center column(17) can be traced as a template. Some cartons already have a circular knockout in the top of the carton. This can be used as is or it may have to be enlarged. Carton(44) is then placed on the device so that center column(17) extends up through the holes in carton(44). The hole in the bottom of carton(44) will fit tightly around the outside diameter of lower portion (16) of center column (17) keeping carton(44) centered on the device. The loose end of a wire(46) in the center of the coil is then pulled through the space between the edge of the top hole in carton(44) and upper portion (14) of center column (17).

When the loaded device is operated in sitting position and wire(46) is pulled, it causes the entire coil of wire and carton(44) and the upper section of the device to rotate on turntable bearing(20). In the suspended position the entire device and carton(44) rotate on bearing(28), except for the handle strap(38) and handle grip(30) which is suspended from suspension hook(48) in groove(32). In the hand held position the device operates the same as in the suspended position except that it can be moved as it operates.

When the carton(44) is removed from the device any wire left in the carton is still in a neat coil ready to be used at another time.

The descriptions and specifications discussed above should not be construed as limiting the scope of the invention but as merely providing illustrations of some of the presently preferred embodiments of this invention. The scope of the invention should be determined by the claims rather thean by the examples given.

I claim:

1. A device for holding, transporting, and unwinding coiled wire supplied in a cardboard carton comprising (a) a base,
(b) a coil and carton support,
(c) a center column with flared top and bottom fixed to said support and extending up therefrom,
(d) bearing means rotatably mounting said support to said base,
(e) a handle mounted to top of said center column,
(f) bearing means rotatably mounting said handle to said center column,
(g) hanging means for said handle allowing complete device to be suspended.

2. The device of claim 1 wherein said handle is recessed in top of said center column.

3. The device of claim 1 wherein said handle is retractable into the top of said center column.

4. The device of claim 1 wherein said handle has a groove in hand grip which allows a center of gravity positioning of said hanging means.

5. The device of claim 1 wherein a single bolt holds said handle to said center column, said center column to said coil and carton support and said coil and carton support to said base, and also holding in place bearing means for said handle and a bearing means for said center column and said coil and carton support.

6. The device of claim 1 wherein said center column and said coil and carton support are molded as a single unit.

7. The device of claim 1 wherein said center column consists of two identical sections fastened to each other as if one were the mirror image of the other.

8. The device of claim 1 wherein said base and said coil and carton support are two identical units and have provisions for mounting and centering said bearing means.

9. The device of claim 8 wherein said base and said coil and carton suppport are molded material.

10. The device of claim 7 wherein said center column sections are molded material.

11. The device of claim 1 wherein top of said centter column is circular and can be used as a template to cut holes in a carton of coiled wire.

* * * * *